United States Patent [19]

Bohlin et al.

[11] Patent Number: 4,458,975

[45] Date of Patent: Jul. 10, 1984

[54] CABLE CLAMP

[75] Inventors: Ake E. Bohlin; Rune V. Peterson, both of Alingsås, Sweden

[73] Assignee: Telefonaktiebolaget L M Ericsson, Stockholm, Sweden

[21] Appl. No.: 471,016

[22] Filed: Mar. 1, 1983

[30] Foreign Application Priority Data

Mar. 19, 1982 [SE] Sweden ..... 8201782

[51] Int. Cl.[3] ..... H01R 4/36

[52] U.S. Cl. ..... 339/243; 339/272 R

[58] Field of Search ..... 339/272, 243, 244, 246, 339/247, 248, 75

[56] References Cited

U.S. PATENT DOCUMENTS

| | | | |
|---|---|---|---|
| 2,129,086 | 9/1936 | Fotch | 339/272 B |
| 2,381,331 | 8/1945 | Ayers | 339/272 UC |
| 2,713,672 | 7/1955 | Allen | 339/272 UC |
| 3,325,776 | 6/1967 | Eppler | 339/272 R |
| 3,538,492 | 11/1970 | Genovese | 339/272 A |
| 3,715,707 | 2/1973 | Anderson | 339/272 A |
| 3,891,298 | 6/1975 | Yorgin et al. | 339/272 R |

FOREIGN PATENT DOCUMENTS

| | | | |
|---|---|---|---|
| 7703400-7 | 7/1979 | Sweden . | |
| 564261 | 7/1975 | Switzerland | 339/272 R |
| 1268162 | 3/1972 | United Kingdom | 339/272 R |

*Primary Examiner*—John McQuade
*Assistant Examiner*—David L. Pirlot
*Attorney, Agent, or Firm*—Roberts Spiecens & Cohen

[57] ABSTRACT

In a cable clamp intended for connecting a cable conductor to a connecting tongue (4) protruding from a flat metal element a stirrup (1) surrounding a U-shaped contact member (2) and a pressure plate (7), and a screw (3) screwed through the crown of the stirrup. There is a boss (6) arranged on the side of the contact member (2) facing the tongue (4) and adapted for accommodation in a hole in the tongue. A U-shaped resilient wire bale (5) has bent ends engaged in holes and recesses (9) in flanges (8) of the contact member (2), closely embracing the tongue (4) such that the bale, when lowered into a position along the tongue, will coact with the boss (6) and lock the contact member to the tongue, and, when raised to a position at right angles to the tongue, will allow the contact member to be released from the tongue.

3 Claims, 3 Drawing Figures

CABLE CLAMP

FIELD OF THE INVENTION

The present invention relates to a cable clamp for connecting electrically and mechanically the aluminum conductor of a cable to a connecting tongue protruding from a flat metal element, e.g. in electrical switch apparatus of terminal cabinets.

BACKGROUND

Many types of cable clamps for aluminum conductors have already been tried, and with these it has been found that after a period of time, the conductor yields to the conductor's clamping force, the compression force thus decreasing so that the number of contact points decreases. The result of this is that heat generation by the current flow will become greater than permitted, and the temperature of the conductor may then become so high that the conductor melts and is destroyed. A further problem with aluminum conductors is that even if the conductor is divided into a plurality of wires, it will be considerably stiffer than the corresponding multiwire copper conductor would have been, and is therefore difficult to bend and put into the cable clamp.

In Swedish Pat. SE-C No. 7703400-7 a cable clamp is disclosed in which there is included a stirrup around the end of the conductor and the tongue of the flat metal element, a screw to give the clamping force and a parted conduct member surrounding the end of the conductor. All the parts are made from aluminum, so that alteration of the clamping force due to changes in temperature, and corrosion due to contact between different metals are avoided. In order to solve the problem with the stiffness of the aluminum conductor, the contact member of the cable clamp is divided into a U-shaped part and a pressure plate, which are kept together by serrations on coacting surfaces. It has thus been possible to apply and clamp the contact member of the cable clamp on the stripped cable conductor without substantially bending it.

SUMMARY OF THE INVENTION

The invention is characterized by the provision of a U-shaped resilient wire bale whose ends are bent and engaged in holes and recesses in flanges of the contact member which closely embrace the tongue protruding from the flat metal element. The bale has a lowered position along the tongue in which the contact member is locked to the tongue by cooperation of the bale with a boss on the contact member engaged in a bore in the tongue. The bale has a raised position at right angles to the tongue in which the contact member can be released from the tongue.

With the inventive cable clamp it will be possible, at the commencement of fitting a cable in switch apparatus or the like, to lock the contact member of the clamp to the tongue of the flat metal element so that it does not fall off during continued fitting. It will be subsequently easy to place the stiff aluminum conductor in the contact member.

BRIEF DESCRIPTION OF THE DRAWINGS

The invention will now be described in the following with reference to the appended drawing, wherein.

DETAILED DESCRIPTION OF ONE EMBODIMENT OF THE INVENTION

Figure 1:
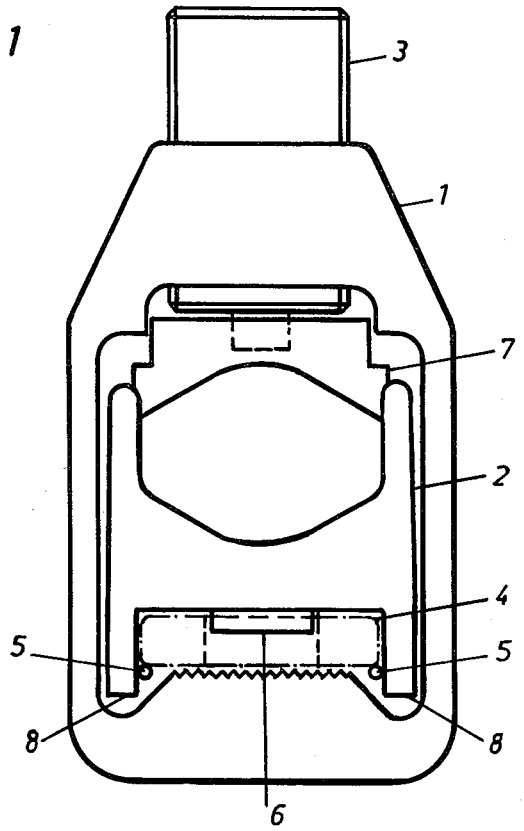
FIG. 1 illustrates a complete cable clamp.

In one embodiment exemplifying the inventive cable clamp there is included, as shown in FIG. 1, a stirrup 1, surrounding a U-shaped contact member 2 and a pressure plate 7. The stirrup 1 also surrounds a tongue 4 protruding from a flat metal element. The intention is to place an aluminum cable conductor in the space between the contact member 2 and the pressure plate 7.

A screw 3 is threaded in a through hole in the crown of the stirrup. At its end facing the pressure plate 7, the screw is formed with a dowel engaged in a bore in the pressure plate. The screw is rotatably mounted in the pressure plate by rivetting the dowel end. The screw 3 is provided with engagement means, e.g. a hexagonal recess, for a tightening tool.

For secure attachment of the cable clamp to the tongue of the flat member, a boss 6 is arranged conventionally on the side of the contact member 2 intended to bear against the tongue 4, there being a hole in the tongue for accomodating the boss.

Figure 2:
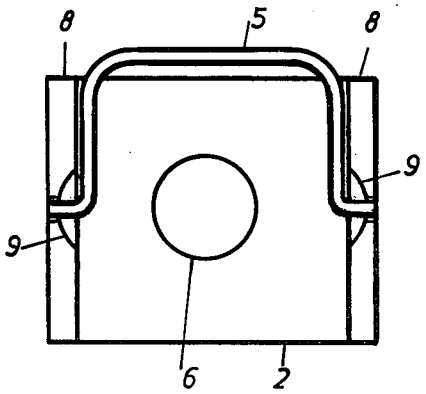
FIG. 2 illustrates a contact member of the cable clamp.

As will be seen from the view of its underside in FIG. 2, the contact member 2 is furthermore provided with two flanges 8 on opposing edges at the underside thereof. At the middle of the flanges, on their insides, there are recesses 9, which are also provided with holes in which angularly bent ends of a wire bale 5 are accommodated. The bale 5 is made from steel wire and is otherwise U-shaped with legs of a length such that its transverse portion is approximately at the edge of the contact member when the bale is lowered into it as is illustrated in FIG. 2.

The width between the flanges 8 is adjusted to the width of the protruding tongue 4 such that the tongue is closely surrounded by the flanges in a manner seen from FIG. 1. It will be seen that when the bale 5 is lowered down along the tongue, the contact member 2 is prevented by the bale from being lifted away from the boss 6 of the contact member and thereby prevented from being thrust along the tongue and released.

Figure 3:
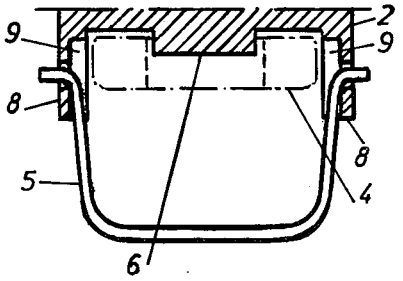
FIG. 3 is a sectional view through the contact member.

When the bale 5 is raised up at right angles to the projecting tongue 4 as shown in FIG. 3, the bias created in the bale during manufacture causes it to expand into the recesses 9, so that the contact member 2 can be lifted to free the boss 6 from the hole in the tongue, and member 2 can subsequently be completely released from the tongue 4.

When the cable clamp is put to use, the contact member 2 with the bale 5 raised is passed over the tongue 4 and its boss 6 fitted into the hole in the tongue. The bale is then lowered along the tongue, whereby the contact member is locked to the tongue. The stripped end of a cable conductor is placed in the contact member. The stirrup 1 accompanied by the screw 3 and pressure plate 7, with the screw screwed out to a miximum is then passed over the contact member and cable conductor, whereon the screw is tightened.

The cable clamp is suitably manufactured in several embodiments of different sizes for different conductor areas and connecting tongues, all with the implementation described here.

In the described example of the cable clamp, all parts with the exception of the wire bale are made from aluminum for use with aluminum cable conductors. Cable clamps from other material also, intended for conductors other than aluminum conductors, are intended to be made in accordance with the described invention.

We claim:

1. In a cable clamp for connecting a cable conductor to a connecting tongue protruding from a flat metal element, the clamp having a stirrup surrounding a U-shaped contact member and a pressure plate, and a screw threaded in the stirrup and engaging the pressure plate, the contact member having a side facing the tongue with a boss thereon adapted for accommodation in a bore provided in the tongue, the improvement comprising a U-shaped resilient wire bale having bent ends engaged in holes and recesses in flanges of the contact member which closely embrace the tongue, said bale in a lowered position along the tongue locking the contact member to the tongue by cooperating with said boss, and in a raised position, at right angles to the tongue, allowing the contact member to be released from said tongue.

2. The improvement as claimed in claim 1 wherein said wire bale is made from steel.

3. The improvement as claimed in claim 2 wherein said stirrup, contact emmber and pressure plate are made from aluminum.

* * * * *